United States Patent [19]

Wasserlein

[11] Patent Number: 4,695,110

[45] Date of Patent: Sep. 22, 1987

[54] ELECTRICAL CONNECTOR APPARATUS

[75] Inventor: Henry G. Wasserlein, Seminole, Fla.

[73] Assignee: Amp Incorporated, Harrisburg, Pa.

[21] Appl. No.: 789,592

[22] Filed: Oct. 21, 1985

[51] Int. Cl.[4] ..... H01R 25/00

[52] U.S. Cl. ..... 439/289; 439/864

[58] Field of Search ..... 339/47–49, 339/272, 274

[56] References Cited

U.S. PATENT DOCUMENTS

| | | | |
|---|---|---|---|
| 2,171,726 | 9/1939 | Howell | 339/47 R |
| 3,143,384 | 8/1964 | Senior, Jr. | 339/60 R |
| 3,226,667 | 12/1965 | Senior, Jr. | 339/60 R |
| 4,029,383 | 6/1977 | Harding et al. | 339/274 |
| 4,060,299 | 11/1977 | Williams | 339/48 |
| 4,128,295 | 12/1978 | Bunnell | 339/274 |
| 4,128,296 | 12/1978 | Lauterbach et al. | 339/274 |
| 4,501,459 | 2/1985 | Chandler et al. | 339/48 |
| 4,595,251 | 6/1986 | Moulin | 339/48 |

*Primary Examiner*—Gil Weidenfeld
*Assistant Examiner*—Paula A. Austin
*Attorney, Agent, or Firm*—Robert W. Pitts

[57] ABSTRACT

An electrical assembly for mechanically and electrically coupling lengths of cables having stripped ends. The assembly comprises two identically constructed, electrically conductive, eccentric terminals, each for receiving and terminating a stripped cable end to be coupled. A bayonet is formed on the front end of each terminal. Each bayonet includes a male and female attachment member adapted to be latched in contact with another like bayonet to form a rotatably disengagable hermaphroditic coupling which is rotatably disengagable. A leaf spring is attached to each terminal to releasably secure the bayonets together. Two identically constructed, electrically insulating housings and a separable sleeve formed of mating male and female sleeve portions shroud the terminals prior to coupling and attach together to provide a watertight enclosure for sealing the terminals during operation and use.

24 Claims, 12 Drawing Figures

ELECTRICAL CONNECTOR APPARATUS

BACKGROUND OF THE INVENTION

1. Field of the Invention

The invention relates to apparatus for electrically coupling cables and, more particularly, to an assembly to effect the releasable coupling, electrical and mechanical, of separate lengths of electrical cable through the use of hermaphroditic components in an electrically safe, watertight enclosure.

2. Description of the Prior Art

Electrical connector assemblies for coupling one electrical power transmission cable to another are well known and are in wide use today. Such assemblies often find their utility at outdoor work sites where they are subjected to rain, wind and other adverse conditions such as dropping, twisting, dragging and the like. A typical field where such assemblies, including the assembly of the present invention, might be utilized would be in solar power arrays as well as other similar fields. As can be appreciated, electrical connector assemblies must be ruggedly constructed to withstand such adverse conditions of use, but yet be electrically safe, economically manufactured, convenienlty assembled and yet maintain their coupled relationship until their separation is intentially effected by an operator.

Such assemblies normally include electrically conductive terminals fastened to the stripped ends of the electric cables to be coupled. The terminals may then be joined to effectively couple the cables electrically.

One technique for joining a terminal to a cable end employs a cam interconnection to supply a secure mechanical connecting as well as a good electrical coupling between the cable end and the terminal. By cam interconnection it is meant the provision of a cam surface in one terminal part and a cam surface engaging portion in a mating terminal part. The interconnection is effected upon rotation of one terminal part with respect to the other so that the camming action causes both a secure mechanical connection and electrical coupling. This prior approach is disclosed in U.S. Pat. Nos. 4,128,295 to Bunnell and 4,128,296 to Lauterbach. In those patents, cable terminals are disclosed which are formed of two elements or parts having bores offset from the axis of rotation of the parts to effect the desired camming action for superior termination. Such apparatus, however, does not disclose an assembly for coupling terminals to each other.

Additional utility is provided to terminals by the utilization of an electrically insulating structure to enclose and protect the terminals from water, air or other undesirable media including the elements which might be detrimental to the reliable transmission of electrical power if allowed to contact the terminals. Further utility is provided to electrical connector assemblies by a design which provides for convenient connection and separation of the terminals while maintaining a secure coupling therebetween during operation and use. Yet further utility is provided to such assemblies by employing components which are essentially universal with some identically formed and some similarly formed parts so that one connector half may mate with any like half. This feature insures the shielding or shrouding of the electricity conducting elements of both halves of the electrical connector assembly prior to their coupling to promote the safety of the apparatus. This feature also reduces costs of manufacturing and maintaining inventory. All of these factors are desirable objectives to improve the safety, convenience, durability and economy of electrical connector asssemblies.

Various approaches have been made in the past in an effort to attain these and other objectives and to overcome the shortcomings previously attendant with the coupling of ends of electrical cables. Two such approaches are disclosed in U.S. Pat. Nos. 3,143,384 and 3,226,667, both to Senior. According to those disclosures, male and female terminals are secured to cable ends. A linear, axial force, followed by a rotational force with respect to the terminals, will effect an appropriate mechanical connection and electrical coupling of the cable ends. The components of the assemblies of Senior, however, are dissimilar, one with respect to the other, and are fabricated to include precise pins, cutouts, latches, coil springs, and the like, all tending to increase the manufacturing costs of the assemblies and complicate the installation procedures. Other U.S. Patents including U.S. Pat. Nos. Re. 25,506 to Stevens; 3,522,578 to Newman; and 3,681,742 to Newman describe subsequent variations on the complex and ineffective assemblies of Senior.

None of these prior approaches to electrical connector assemblies could truly be considered as allowing for the safe, convenient coupling and uncoupling of the halves of the connector while maintaining their secure coupling during operation and use, being separable only when intentionally disengaged by an operator. None allows for identically shaped connector ends which are hermaphroditic with male and female connector parts to allow any terminal to connect with any other like terminal insuring operator safety prior to, during and following the coupling. None discloses the complete watertight sealing enclosure for the terminals and cable ends for increased durability and extended like employing a maximum number of identical parts for increased convenience and economy.

As illustrated by the great number of prior patents, efforts are continuously being made in an attempt to economically and conveniently releasably couple cable ends. Nothing in the prior art, however, discloses or suggests the present inventive combination of component elements as described herein.

The present invention achieves its purposes, objectives, and advantages over the prior art through a new, useful, and unobvious combination of component elements for mechanically and electrically coupling cable ends, all with a minimum number of functioning parts, at a reduced of cost, and through the utilization of only readily available materials and conventional components.

These objectives and advantages should be construed as merely illustrative of some of the more prominent features and applications of the present invention. Many other beneficial results can be attained by applying the disclosed invention in a different manner or by modifying the invention within the scope of the discloure. Accordingly, other objects and advantages as well as a fuller understanding of the invention may be had by referring to the summary of the invention and detailed description describing the preferred embodiment of the invention in addition to the scope of the invention as defined by the claims taken in conjunction with the accompanying drawings.

SUMMARY OF THE INVENTION

The present invention is defined by the appended claims with the specific preferred embodiment shown in the attached drawings. For the purposes of summarizing the present invention, the invention may be incorporated into apparatus, for use in an electrical connector assembly, comprising an electrically conductive terminal for attachment to an end of a length of cable. The terminal comprises a stator member and a rotor member rotatable with respect to each other about an axis of rotation. The stator member and the rotor member each have a bore offset from the axis of rotation for receiving a cable end when the bores are in alignment along a common axis and for terminating the received cable end when the bores are out of axial alignment as a result of relative rotation between the stator member and the rotor member. A bayonet is formed on the front end of one of the members and is adapted to be positioned in contact with an associated electrical element. A resilient means is attached to the bayonet for releasably latching the bayonet in contact with the associated electrical element. The terminal further includes a cylinder extending frontwardly of the bayonet to shroud the bayonet. One face of the bayonet lies adjacent the axis of rotation and includes attachment means on that one face located to one side only of the axis of rotation and includes a male projection and female recess axially aligned on that one face. The resilient means includes a leaf spring facing that one face. The resilient means further includes side supports attached at their radially interior ends to the bayonet and at their radially exterior ends to the leaf spring.

The invention may also be incorporated in an electrical connector assembly for mechanically and electrically coupling lengths of cable. The assembly includes two halves. Each half comprises an electrically conductive terminal for receiving and terminating the ends of a cable. Each terminal is hermaphroditic with male and female connecting parts arranged so that any terminal may latch with any other like terminal. The apparatus further includes an electrically insulating housing having a central aperture adapted, at its rear end, to receive the cable adjacent its end. The aperture is also adapted, at its front end, to receive the terminal. The housing also has, adjacent its front end, a circumferentially located attachment means on its radially exterior surface. Each housing is of an identical construction so that any housing may couple with any other like housing. The apparatus further includes an electrically insulating separable sleeve having sleeve portions. Each sleeve portion has, at its rear end, on its radially interior surface, a circumferentially located attachment means for releasably coupling with the attachment means on the housing. The sleeve portion also has additional means, at its front end, for being releasably coupled with the associated half. The sleeve portions for each assembly are male and female for being mutually coupled adjacent their front ends and for being coupled adjacent their back portions and their associated housings. The front part of one of the sleeve portions may be cylindrical with its exterior surface at a fixed distance from the axis of rotation and with its interior surface tapering radially exteriorly away from the housing. The front part of the other of the sleeve portions may be cyindrical with its interior surface at a fixed distance from the axis of rotation and with its exterior surface tapering radially interiorly away from the housing. The front part of the sleeve portion is cylindrical with an interior surface and an exterior surface and further includes attachment means on the interior surfaces. The bayonet has an essentially flat face containing the connecting parts and located adjacent the axis of rotation whereby the flat face may be positioned in contact with the flat face of an associated bayonet to which its to be connected with their connecting parts in mating relationship. The connecting parts are rotatably disengageable so that rotation between connected bayonets will separate their flat surfaces and disengage their connecting parts and thus allow an axial movement therebetween to separate the previously connected bayonets and terminals.

The invention may yet be incorporated in an electrical assembly for mechanically and electrically coupling lengths of cables with ends. The assembly comprises two identically constructed, electrically conductive terminals, each of receiving and holding a cable end to be coupled. Each terminal comprises a stator and a rotor rotatable with respect to each other about an axis of rotation. The stator and the rotor each have a bore offset from the axis of rotation for receiving a cable end when the bores are in alignment along a common axis and for holding the received cable end when the bores are out of axial alignment as a result of relative rotation between the stator and the rotor. A bayonet is formed on the front end of the stator and adapted to be positioned in electrical contact with each other and further includes resilient means on each terminal to releasably secure the bayonets together. The assembly further includes two identically constructed, electrically insulating housings, one for each terminal. Each housing has a central aperture adapted, at its rear end, to receive a cable adjacent its end. Each housing is adapted, at its front end, to receive the terminal. Each housing also has a circumferentially located attachment means on its radially exterior surface adjacent its front end. Each separable sleeve is formed of mating sleeve portions, each sleeve portion having, at its rear end, on its radially interior surface, a circumferentially located attachment means for releasably coupling with the attachment means on the housing. Each sleeve portion also has, at its front end, additional means to releasably couple the sleeve portions to each other.

The front parts of both of the sleeve portions are cylindrical with the interior surface of one of the parts at a fixed distance from the axis of rotation and with its exterior surface tapering radially interiorly away from its associated housing and with the exterior surface of the other of the parts at a fixed distance from the axis of rotation and with its interior surface tapering radially exteriorly away from its associated housing. The sleeve portions further include attachment means on both of the radially interior surfaces. The assembly further includes a radially exteriorly projecting abutment means on the stator and rotor to limit the rotational movement therebetween. The assembly further includes an axial recess within the central aperture adjacent the front end of each housing for receiving the abutment means to effect the proper rotational positioning between each the housing and its associated terminal. The assembly further includes a projection extending axially frontwardly from the front ends of each housing and a recess extending axially frontwardly from the rear end of each sleeve portion for receiving the projections to effect the proper rotational positioning between the sleeve portions and the housings. The assembly also includes additional projection means and recess means on the sleeves to effect the proper rotational positioning between said sleeves. The rear end of each housing includes, on its interior surface, a circumferential compliant lip projecting radially interiorly and frontwardly to contact the cable adjacent its stripped end and preclude the passage of water between the lip and the cable. The attachment means are watertight to thereby constitute a watertight seal for the terminals. The sleeve portions and the housings are fabricated of an elastomeric material with the rear end of each housing being of a durometer hardness less than its front end. Each bayonet has an essentially planar surface in mutual facing relationship located adjacent the axis of rotation and further includes a bayonet attachment means on each essentially planar surface.

Each bayonet attachment means includes a recess and a projection positioned whereby the resilient means will bias the bayonets together with the recesses and projections in mating engagement so as to preclude the axial movement of the bayonets with respect to each other. The bayonet attachment means are located on one side only of the axis of rotation so that counter rotation of the terminals and the bayonets about the axis of rotation will separate the bayonet attachment means of one bayonet from the bayonet attachment means of the other bayonet against the bias of the resilient means to allow the axial movement and separation of the bayonets and the terminals. The projections and the recesses are axially spaced and located at identical positions on each bayonet, so that when the bayonets are in facing, operational contact, the projections and the recesses are in mating engagement and the bayonets thus form a hermaphroditic coupling. Each terminal extends frontwardly of its associated housing and each sleeve portion extends frontwardly of its associated terminal to shield the terminal prior to the coupling of the assembly halves.

The invention may also be incorporated into an electrical connector assembly half wherein a hermophroditic electrical connector assembly half adapted to be coupled with a like half, which half includes an electrically conductive terminal and electrically insulating, terminal-surrounding sleeve extending frontwardly of the terminal to shroud the terminal prior to being coupled.

BRIEF DESCRIPTION OF THE DRAWINGS

For a more complete understanding of the nature, objects, and advantages of the present invention, reference should be had to the following detailed description taken in conjunction with the accompanying drawings in which:

FIG. 3 is a view similar to FIG. 2 but with the terminal fully assembled.

DETAILED DESCRIPTION OF THE INVENTION

Figure 1:
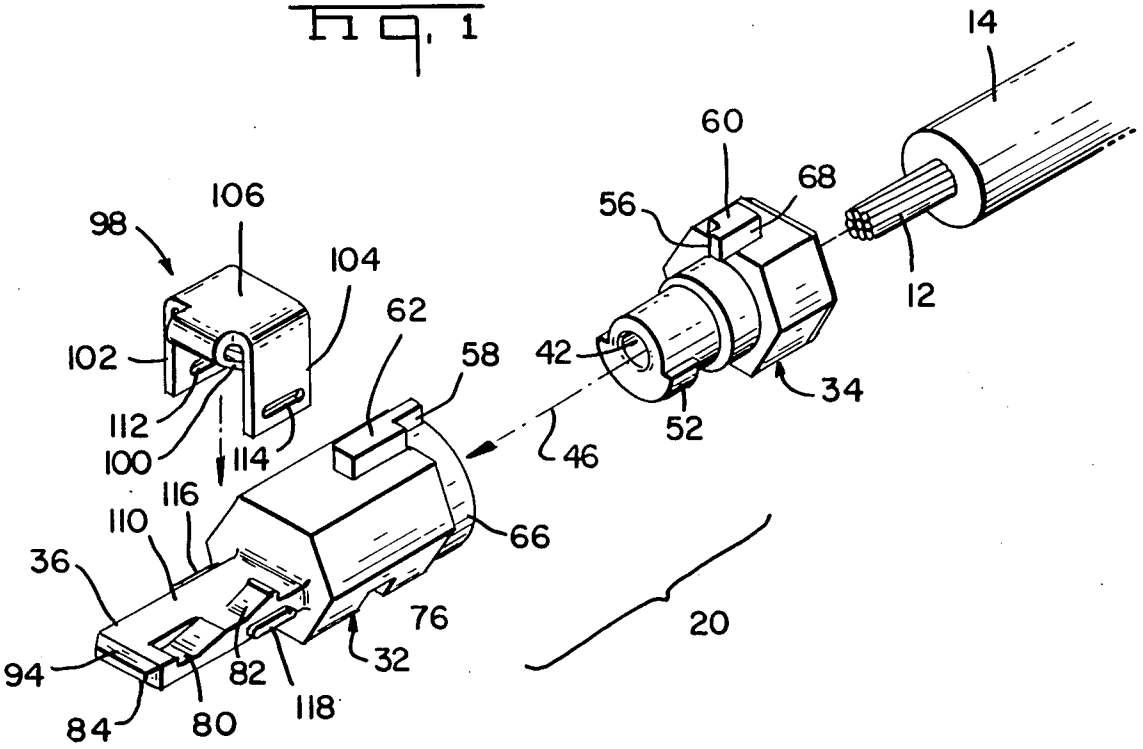
FIG. 1 is an exploded perspective view of an end portion of an electrical cable and one eccentric terminal.

Shown in the various figures is an electrical connector assembly 10 for joining stripped ends 12 of extents or lengths of cable 14 to be mechanically and electrically coupled. The assembly consists of two identically constructed but separate halves 16, 18. In general, each connector half includes an electrically conductive, hermaphroditic, eccentric cable terminating member or terminal 20. By hermaphroditic it is meant that each cable terminating member has both male and female connecting parts to matingly connect or latch and effect their coupling. Each connector half also includes an outer housing 22 identical in construction, one to another. Lastly, each connector half includes a separate sleeve 26 fabricated in two interconnecting portions, one male 28 and one female 30, for connection one to another and for joining the two outer housings.

The halves 16, 18 of the assembly are also hermaphroditic in that they may be coupled with any other like half. All that must be modified might be the sleeve portions so that each coupled assembly includes a male sleeve portion 28 and a female sleeve portion 30. Note is also taken that the uncoupled assembly halves containing two separate sleeve portions may be considered electrically safe inasmuch as the terminals 20 are shrouded or shielded by their associated sleeve portions prior to their being coupled.

Each cable terminal is formed of two elements, a stator 32 and a rotor 34 Each stator is provided with a bayonet 36 extending from its front end. The terms "front", "frontwardly", or the like are intended to mean that end, or toward that end, of an assembly half adjacent the terminal. The terms "back", "backwardly", or the like are intended to mean that end, or toward that end, of the assembly half adjacent the cable.

The rotor constitutes the back end of the terminal with its front end extending into an aperture 40 of the stator. The stator and rotor when brought together prior to receiving the stripped conductive wire bundle of the cable end present bores 42, 44 which are axially aligned along an axis 46, one with respect to another, but which are offset from the axis 48 of rotation of the rotor with respect to the stator. The stripped cable end may thus be inserted into the aligned bores of the terminal. Projection radially exteriorly from the front end of the rotor and projecting radially interiorly from the aperture of the stator are semicirculator projections. 52, 54 Only when these related semicircular projections are fully out of alignment can the front end of the rotor be inserted into the aperture at the back end of the stator. In such orientation, the cable receiving bores are aligned along a common axis 46 offset from the axis of rotation 48 of the stator which is the axis of the outer housings and sleeve portions.

As used herein the terms "radially exterior", "exterior", or the like are intended to mean farther from the axis of rotation of the stator and rotor which is also the axis of the outer housings, sleeve portions, and cable adjacent its stripped end. As used herein the terms "radially interior", "interior", or the like are intended to mean closer to the axis of rotation.

With the cable end inserted into the terminal bores, the rotor is then rotated 180 degrees as by a wrench, pliers, or other appropriate tool until cooperative abutment surfaces 56, 58 on the stator and rotor contact each other to preclude further rotation to indicate the completion of the coupling. The abutment surfaces are located on radially outstanding projections 60, 62 on the rotor and stator 32, 34. The 180 degree rotation will offset the axis of the rotor with respect to the stator to insure a secure mechanical connection and complete electrical coupling of the conductive elements of the cable to the terminal. The back face of the stator is machined to provide an arcuate surface 66 which will coact with an opposite face 68 of the abutment projection 60 of the rotor 34 to effect the termination of the rotation of the stator when the bores are aligned.

During rotation of the parts relative to each other, the passageway defined by the interface 70 of the aligned bores is greatly constricted at the area of contact between the rotor and stator. The conducting core of cables wires exposed by the stripping of the cable is drastically deformed and compressed in this zone. As a result, a high pressure electrical connection is provided between the terminal and the cable.

The radii 72, 74 provide smooth transition surfaces of the cable in this transition zone so that the strands of the cable will not be parted, even if the cable contains fine aluminum wire strands.

During the rotation of the rotor, or male part, relative to the stator, or female part, the inner surfaces of both eccentric bores exert both a transverse shear and a rotational or torsional shear on the constituent strands of the cable. Both shear modes cause the strands to move relative to each other. Initially, this shear causes the strands to compact, but deformation of the strands soon begins. The rotational shear and relative movement of the strands under the force exerted by the constricting rotor and stator results in a scraping or abrasive action which is transmitted through most of the strands in the cable. The scraping action separates the relatively brittle oxide coating which forms on an aluminum conductor from the underlying metal. As the constriction of the cable continues intimate contact and a cold welding occurs between metal surfaces of adjacent strands as well as between the outer strands and the rotor and stator. The electrical contact formed by the presence of the rotational shearing mode is therefore between than that formed by the action of transverse forces alone.

Installation of the device on a stripped conductor end is an extremely simple operation and can be carried out by an operator, even an unskilled technician, at a worksite. Furthermore, the electrical connection can be inspected by merely noting the position of the stator and rotor. If the parts are in the position of FIG. 2 one can be assured that the device is positioned to receive a stripped cable. If the parts are in position as shown in FIG. 3, one can be assured that the stripped cable has been properly secured by the terminal. In addition, the stator is provided with a viewing aperture 76 adjacent its front end. The viewing aperture extends radially from an exterior surface into the bore so that the operator can actually see the stripped cable end prior to the rotation of the rotor as well as after such rotation.

Further details of the coupling operation of the terminal can be had by reference to the patents to Bunnell and Lauterbach referred to hereinabove.

Located on the front end of each terminal is a bayonet 36 provided with a front recess 80, the female member, and a back projection 82, the male member, axially aligned along one side 84 of the bayonet. The recess and projection of each bayonet are positioned for joining one bayonet to another so that the projection of one bayonet will be received in the recess of the other bayonet. Flat surfaces 86, 88 on the projections and recesses, perpendicular to the axis of rotation, abut to preclude axial movement of the bayonets and terminals away from each other during operation and use. The angled surfaces 90, 92, 94 of the recess, projection, and bayonet end allow for their mating of the bayonets, one to another, when axially slid together during the installation process.

Secured to each bayonet is a resilient one-piece member 98 including a leaf spring 100 and fabricated of spring sheet metal such as, for example, phos-bronze. In addition to the leaf spring, the resilient member also includes radially disposed parallel supports or arms 102, 104 and a connecting portion 106 coupling the radially exterior ends of the arms. The connecting portion has an extension constituting the leaf spring which is bent toward the face 110 of the bayonet containing the projection and recess. Slots 112, 114 in the radially inward ends of the arms are received in lateral projections 116, 118 on the bayonet to insure the desired positional relationship. The space between the leaf spring and the opposing face of the bayonet containing the projection and recess is of such extent as to receive and hold a mating bayonet so that the mated bayonets are spring urged face to face on opposite sides of, but adjacent to, the axis of rotation to further preclude their inadvertent axial displacement. The arms 102, 104 preclude inadvertent lateral movement of the bayonets 36 with respect to each other.

The projection 82 and recess 80 of each bayonet extend from one edge of the bayonet to a position short of the axis of rotation. In this manner, the terminals may be counter-rotated to cause the disengagement of the recess and projection of one bayonet from the other. This will permit the axial sliding of the coupled bayonets and the separation of one connector half from the other when such is desired. By counter-rotated it is meant that one gripped half is rotated about the axis of rotation in a direction opposite from the other gripped half.

The rotor and stator including the bayonet are preferably formed as by being die cast of an electrically conductive material, aluminum being preferred. In this manner, the conductive bundle of strands of one cable may be electrically coupled through its associated rotor, stator, and bayonet to the bayonet stator, rotor and bundle of conductive wires of the other half. The extended area of contact between the bayonets by the arrangement of parts as described above, including the pressure as applied by the leaf spring, insures a good electrical contact between the bayonets and, consequently, between the terminals and cables being coupled.

Each connector half also includes an outer housing 22 having a front circumferential wall 120 of an exterior diameter less than that of the central extent of the housing. Each connector half also has a central aperture 122 configured to receive and hold, at its back end, the cable at its insulation 124 adjacent the stripped portion in a watertight manner. This is effected by a circumferential, cylindrical, compliant lip 126 extending radially inwardly and outwardly within the aperture of the housing adjacent the back end of the housing. The compliant lip is of such size and resliency so as to conform, as by radial deformation, to a limited range of cable sizes and still maintain the watertight seal therebetween. It should be understood, however, that the entire assembly and all of its component elements could be in a variety of sizes, larger or smaller, to accommodate a wide variety of cable sizes.

The bayonet 36 extends frontwardly beyond the front edge of the circumferential wall 120 of the housing 22 dso as to expose about half of the bayonet. The exposed extent of the bayonet is for being received in the housing to which it is to be coupled for effecting the electrical coupling between the connector halves.

The safety of an electrical terminal normally is effected by shielding or shrouding that terminal which is coupled to the electrical power source. The terminal coupled to the powered electrical component normally is exposed, not shrouded, since it does not present a safety hazard. In applications such as solar power arrays, for example, the various electrical components may change their electrical characteristics whereby a particular coupled component may at one time be a source of electrical power and at other times be a receiver of electrical power. Because of this characteristic, the requirement arises to shield both electrical terminals of an electrical connector assembly.

The central aperture of the outer housing is shaped to receive the terminal and also includes a bottoming surface 128 for receiving the back face 130 of the terminal. An axial slot 132 within the aperture is positioned to receive the radial projections 60, 62 of the stator and rotor which contain the abutment surfaces.

The axial slot terminates inwardly with the aperture of the housing at the bottoming surface to contact the back surface of the rotor and thus limit the movement of the terminal into the housing. A short axial projection 134 extends frontwardly from the bottoming surface, diametrically opposed to the primary axial slot. The short axial projection coacts with a short recess 136 on the front end of the rotor diametrically opposite from the abutment projections. This arrangement insures the locating of the terminal with respect to the housing and provides additional convenience and stability to the coupling of the terminal and housing to further preclude inadvertent rotational movement therebetween.

The external surface of each housing also includes a bevel 138 on its front surface to facilitate the sliding motion of a separate sleeve portion thereover. A mating bevel 140 on the back edge of the sleeve furether assists in this mating relationship. Each outer housing also includes a circumferential recess 142 constituting an attachment means for receiving an inwardly directed circumferential projection 144, or mating attachment means, radially projecting inwardly from the back end of each separate sleeve.

Figure 8A:
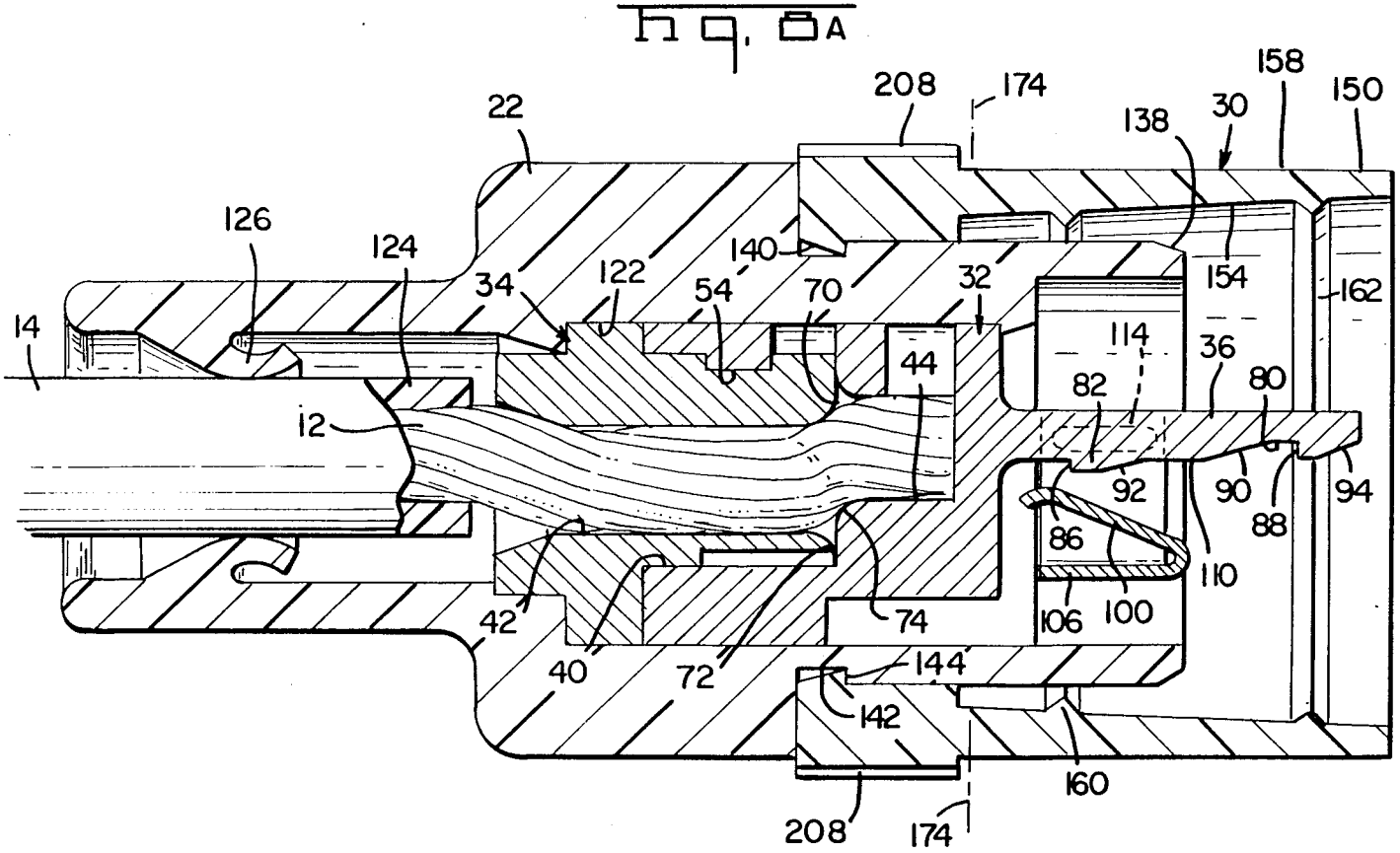
FIGS. 8*a* and 8*b* are axial sectional views of the two halves of the assembly showing the outer housings including their associated terminals and separate male and female sleeve portions respectively, and also showing, partially in section, their associated stripped cable ends.
Figure 8:
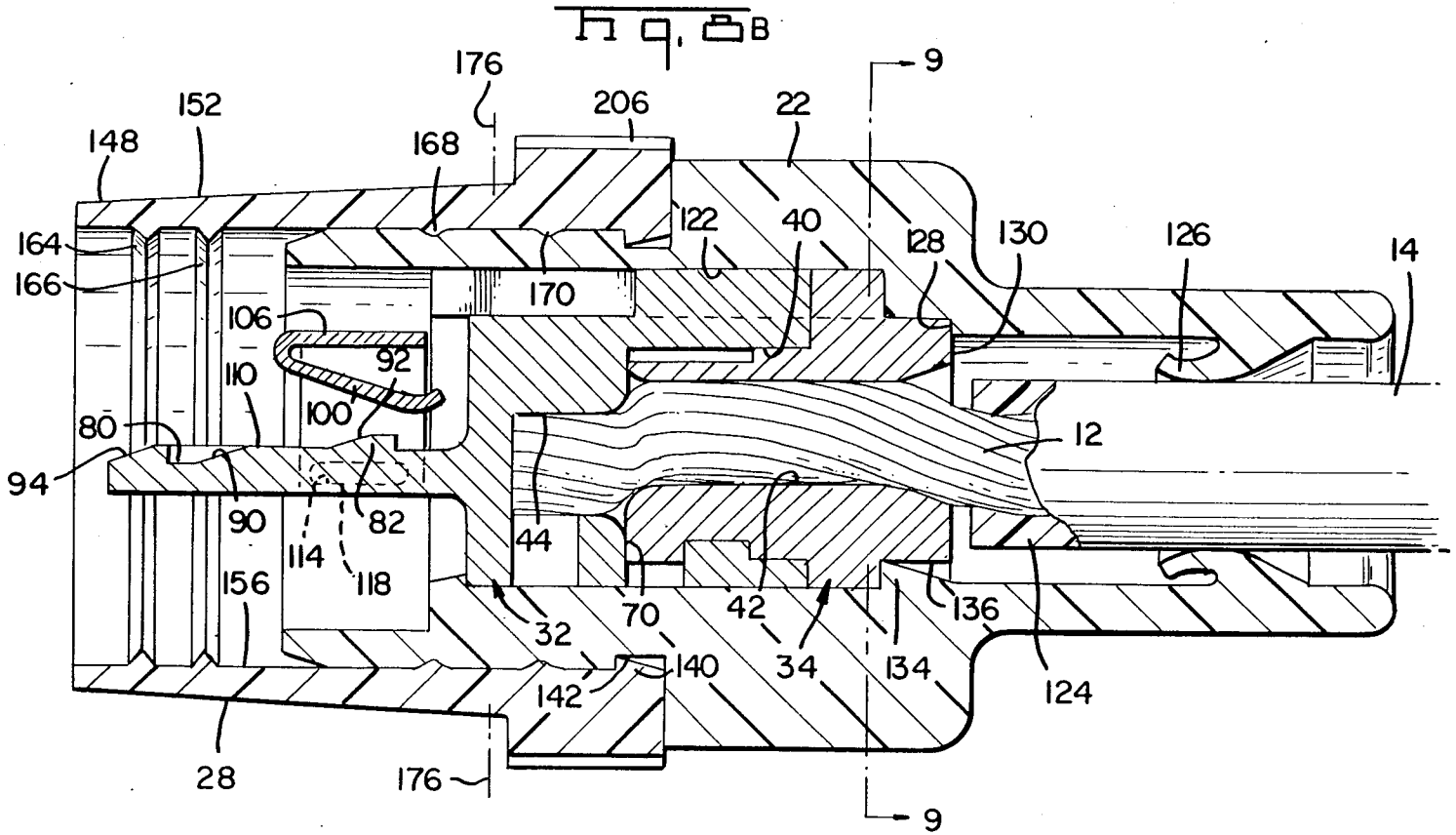
Figure 9:
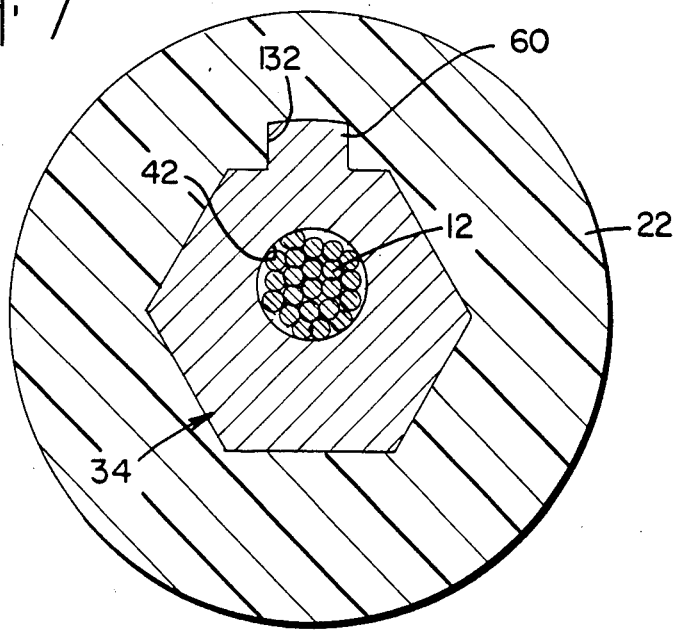
FIG. 9 is a sectional view taken through line 9—9 of FIG. 8*b*.
Figure 11:
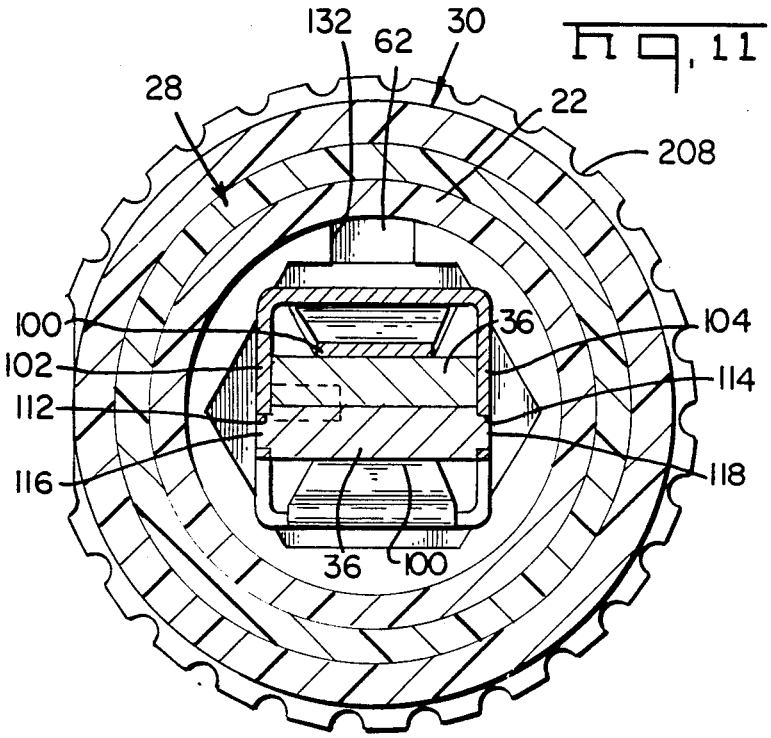
FIG. 11 is a sectional view taken along line 11—11 of FIG. 10.
Figure 10:
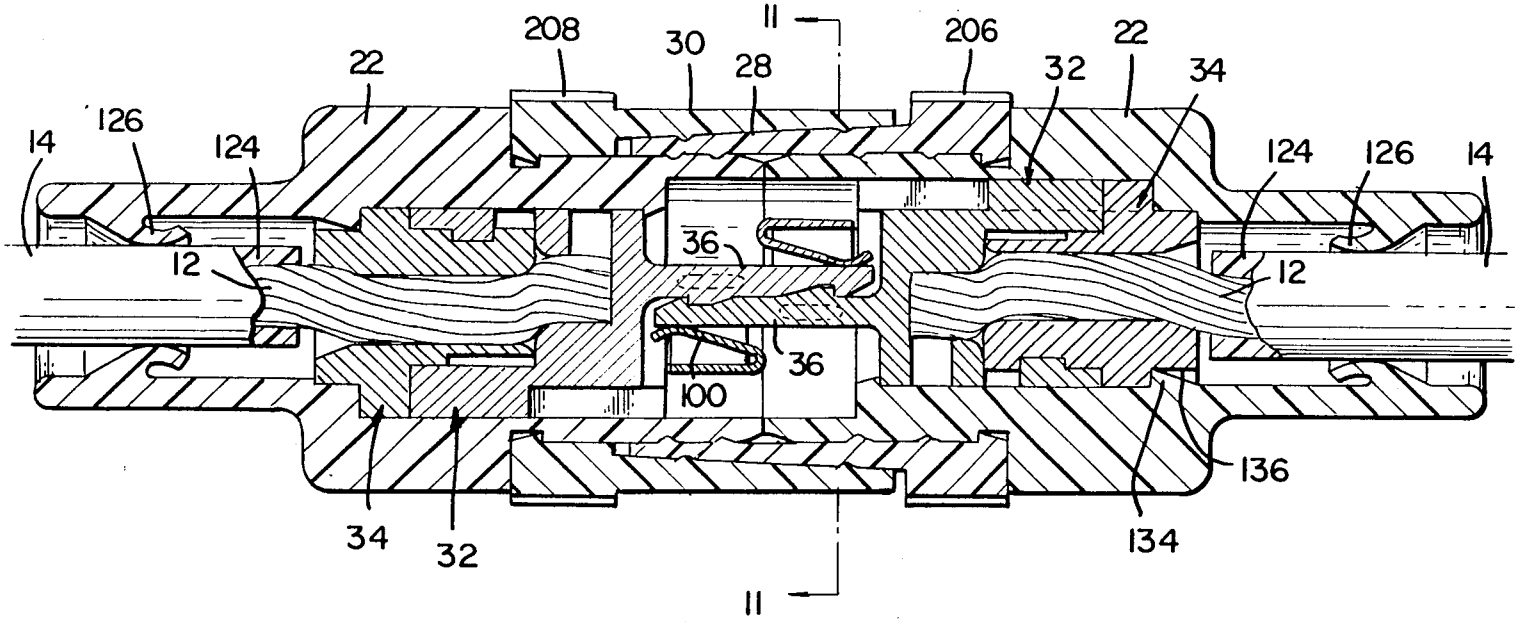
FIG. 10 is an axial sectional view of the assembly halves shown in FIGS. 8*a* and 8*b* but illustrating the halves fully coupled for operation and use.

The last element of the assembly is the separate sleeve 26 which is formed of similarly shaped male and female sleeve portions 28, 30. The sleeve with its portions is separate from the housings to which it is coupled. The sleeve portions are separate, one from another, so that mating assembly halves may be coupled with each sleeve portion shrouding its associated terminal before and during the coupling of the halves. FIG. **8*b* illustrates the male portion while FIG. 8*a* illustrates the female portion. As mentioned previously, the back ends of each sleeve portion of the separate sleeve are provided with a circumferential internal projection 144 for being received within the circumferential recess 142 of each outer housing to constitute an attachment means. Each separate sleeve portion is also provided with an frontwardly projecting part 148, 150 with a tapering circumferential wall 152, 154 and another wall 156, 158 at a fixed distance from the axis of rotation. The female sleeve portion has a plurality of V-shaped radially inwardly directed projections 160, 162** or attachment means on its radially interior face. These projections are positioned to be received on the smooth radially exterior face on the male portion of the separate sleeve.

The male sleeve portion has a plurality of V-shaped radially inwardly directed projections 164, 166, 168, 170 on its radially interior face. These projections, four in number, are positioned so that the two back ones 168, 170 are received on the smooth radially exterior face of the front exterior faces of its associated housing and with the two front ones 164, 166 for being received on the smooth radially exterior face of the opposed housing. All of these various V-shaped projections coact elastically with their respective mating complaint surfaces while the various attachment means, in association with the complaint lip, whereby the outer housings and sleeve portions constitute a watertight enclosure for the terminals.

The frontwardly projecting parts 148,150 of the sleeve portions are of such length that, when the assembly halves are separated, the electrically conductive terminals will be totally shielded or shrouded. If the front ends of the sleeve portions did not extent, beyond the terminals, the terminal ends would be exposed and unsafe to an operator or others in the vicinity since they would constitute exposed electrical ends. When coupled the forward ends of the housing abut and the sleeve portions effectively overlap.

The outer housing 22 and separate sleeve portions 28, 30 are preferably cast or molded of an insulating somewhat flexible elastomeric material to allow the parts to be mechanically connected, one to another, and to resist the action of air, moisture, and other materials to which the terminals of the electrical connector assembly might be subjected. The housings may be fabricated of neoprene, for example, of a dual durometer with the back end of each housing being of a durometer hardness less than its front end. The broken lines 174, 176 in FIGS. **8*a* and 8*b*** indicate the approximate point of separation between one such hardness and the other. Known fabrication techniques may be employed. The watertight attachment means at the areas of connection of the various components of the assembly are all preferably watertight to supplement the materials chosen so as to provide extended life to the assembly and consequently to the terminals. The coupled housings and sleeve portions of each assembly may thus be construed as a watertight enclosure for the terminals.

Inasmuch as the terminals and housings are of identical construction, any assembly half may be attached to any other assembly half. Not only does this minimize the manufacturing cost, it also extends the utility and convenience in the field when changes within the electrical coupling relationships are desired. All that is needed is to verify that one male and one female sleeve portion is utilized for any particular connection.

Figure 2:
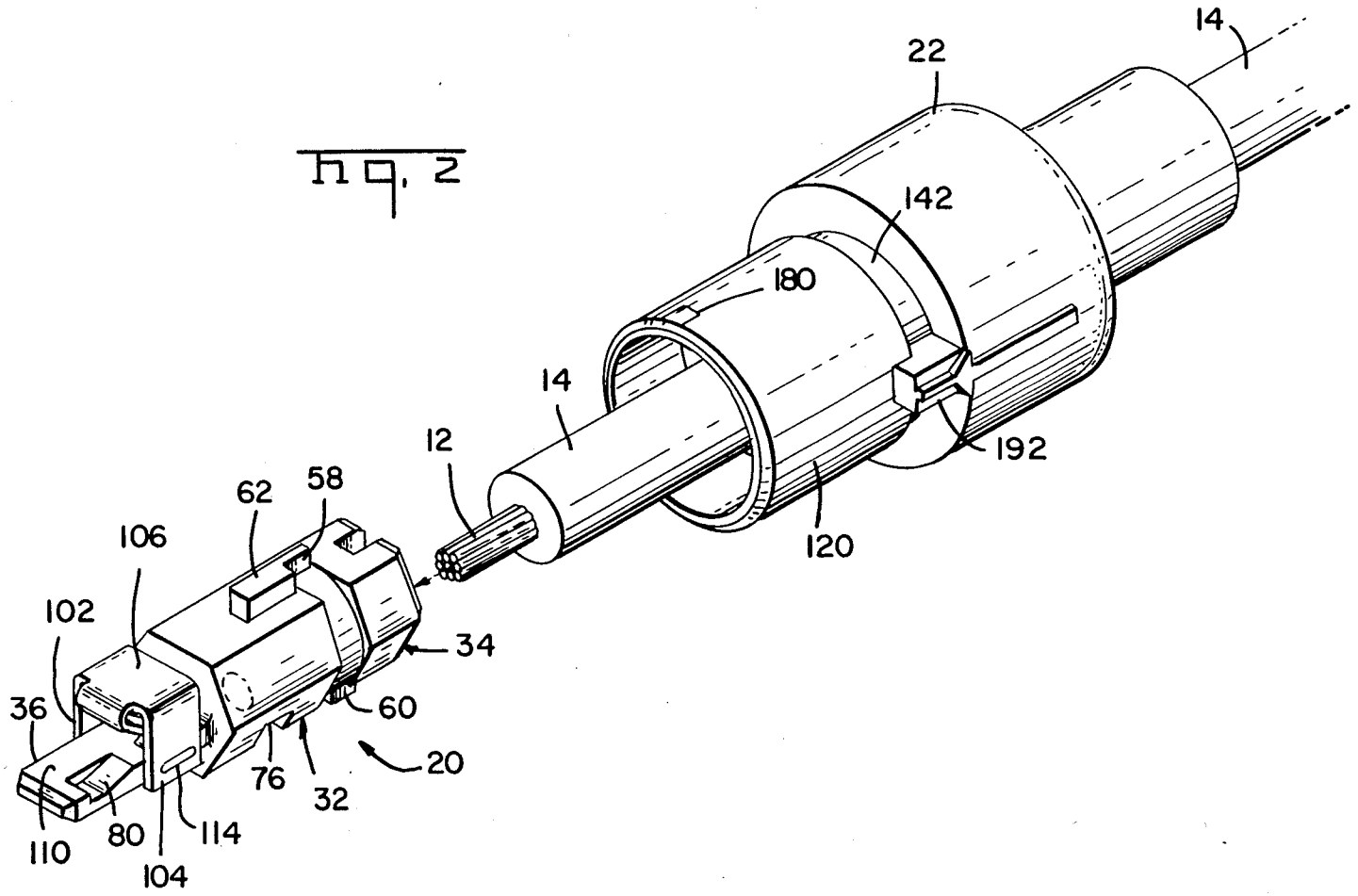
FIG. 2 is an exploded perspective view similar to FIG. 1 but showing the terminal immediately prior to assembly and also showing an outer housing in position on the end of the cable.
Figure 7:
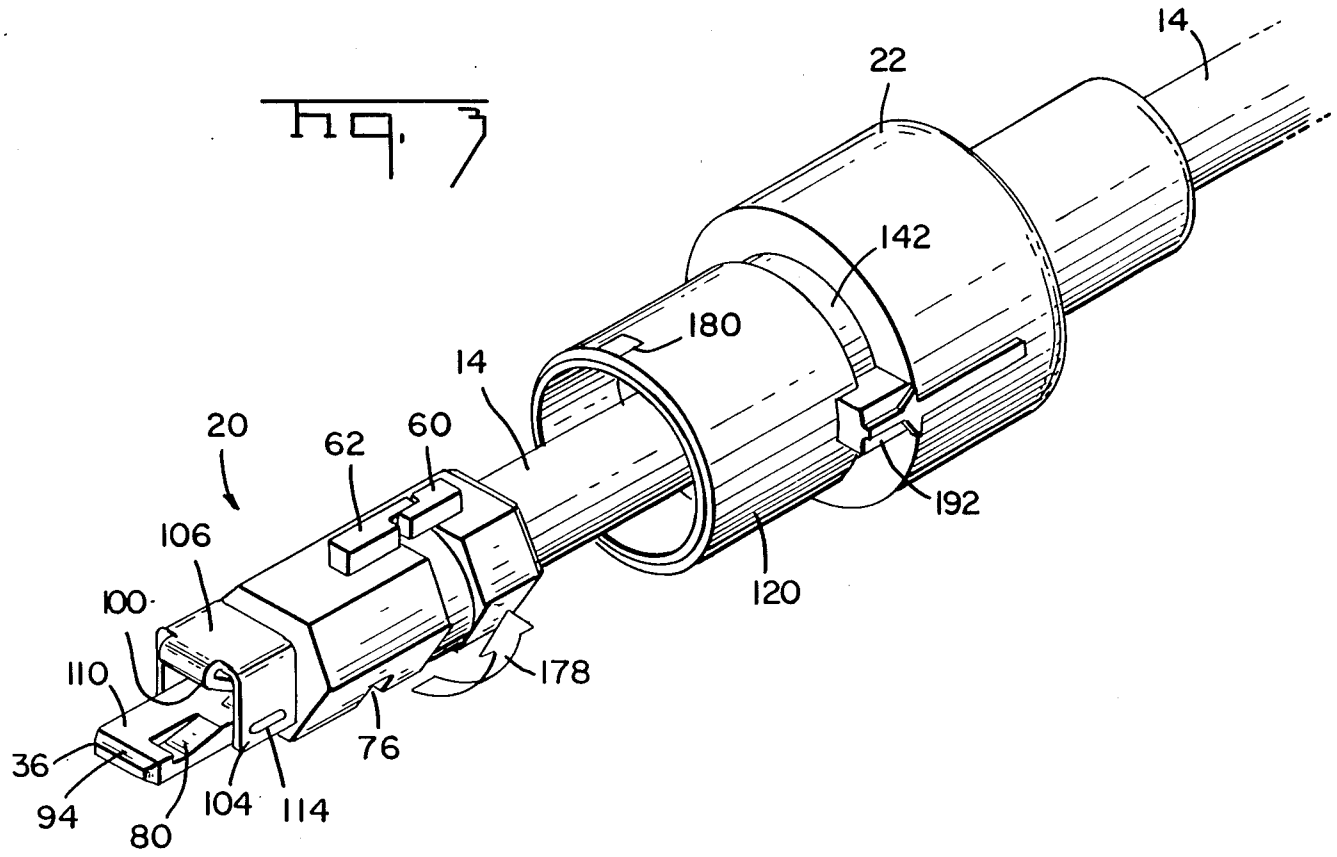
FIG. 7 is an exploded perspective view similar to FIG. 5 but showing the portions of the separate sleeve separated.
Figure 4:
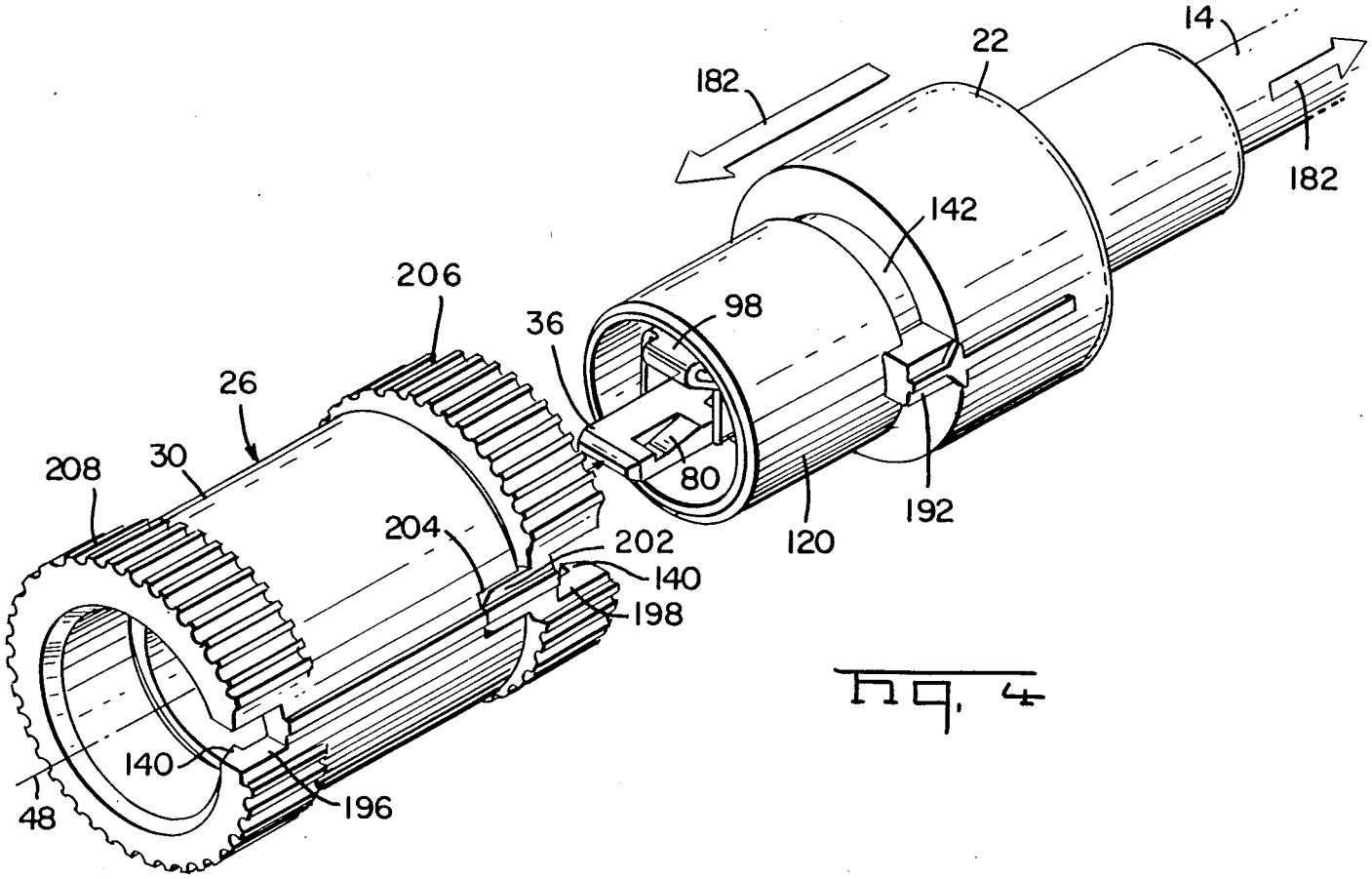
FIG. 4 is a view similar to FIG. 3 but showing the assembled eccentric cable terminating member operatively positioned within its associated outer housing and also showing the separate sleeve prior to its connection to the outer housing.
Figure 5:
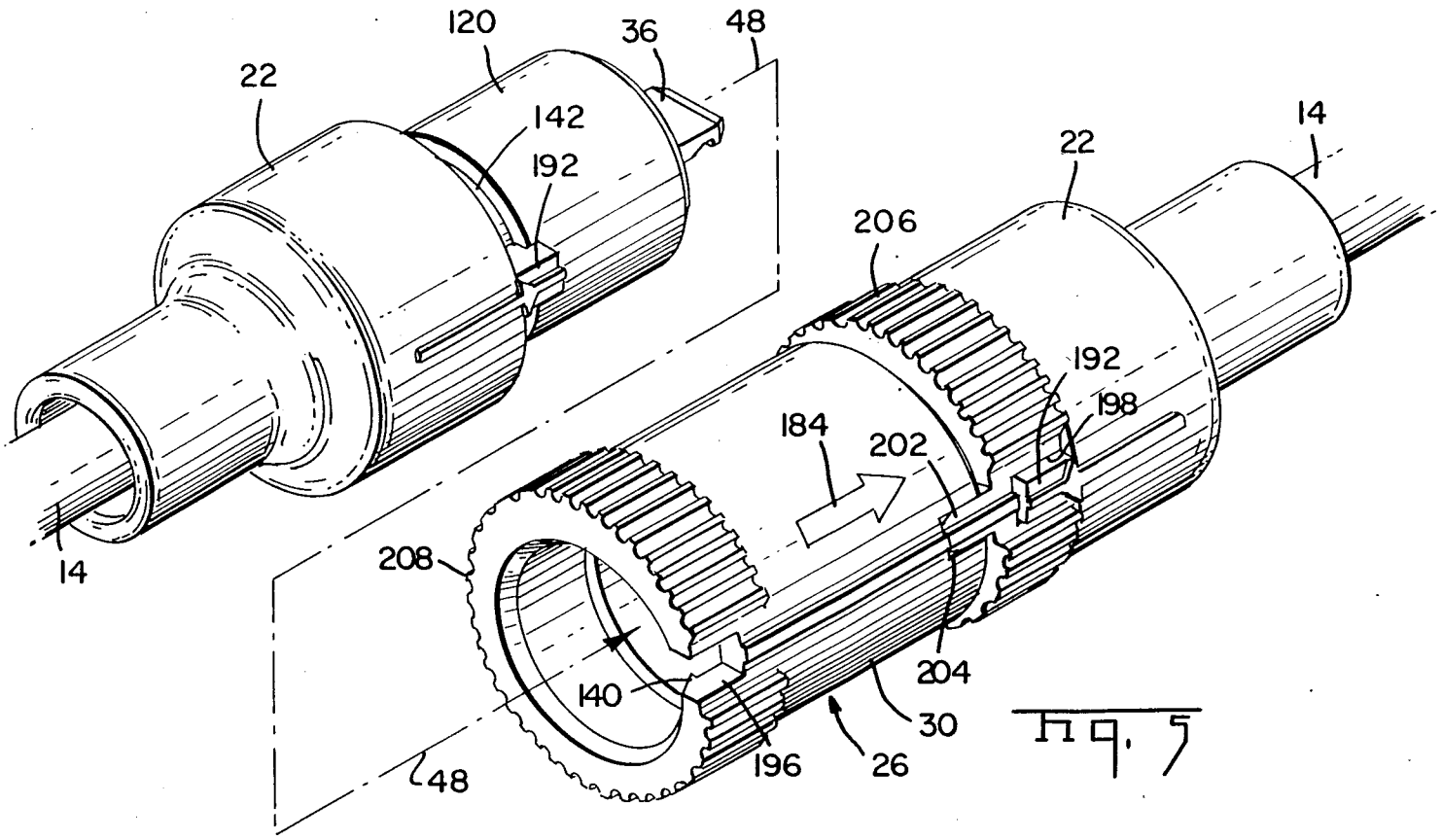
FIG. 5 is a view similar to FIG. 4 but showing the separable sleeve coupled to one outer housing and also showing the other outer housing prior to its connection to the separate sleeve.
Figure 6:
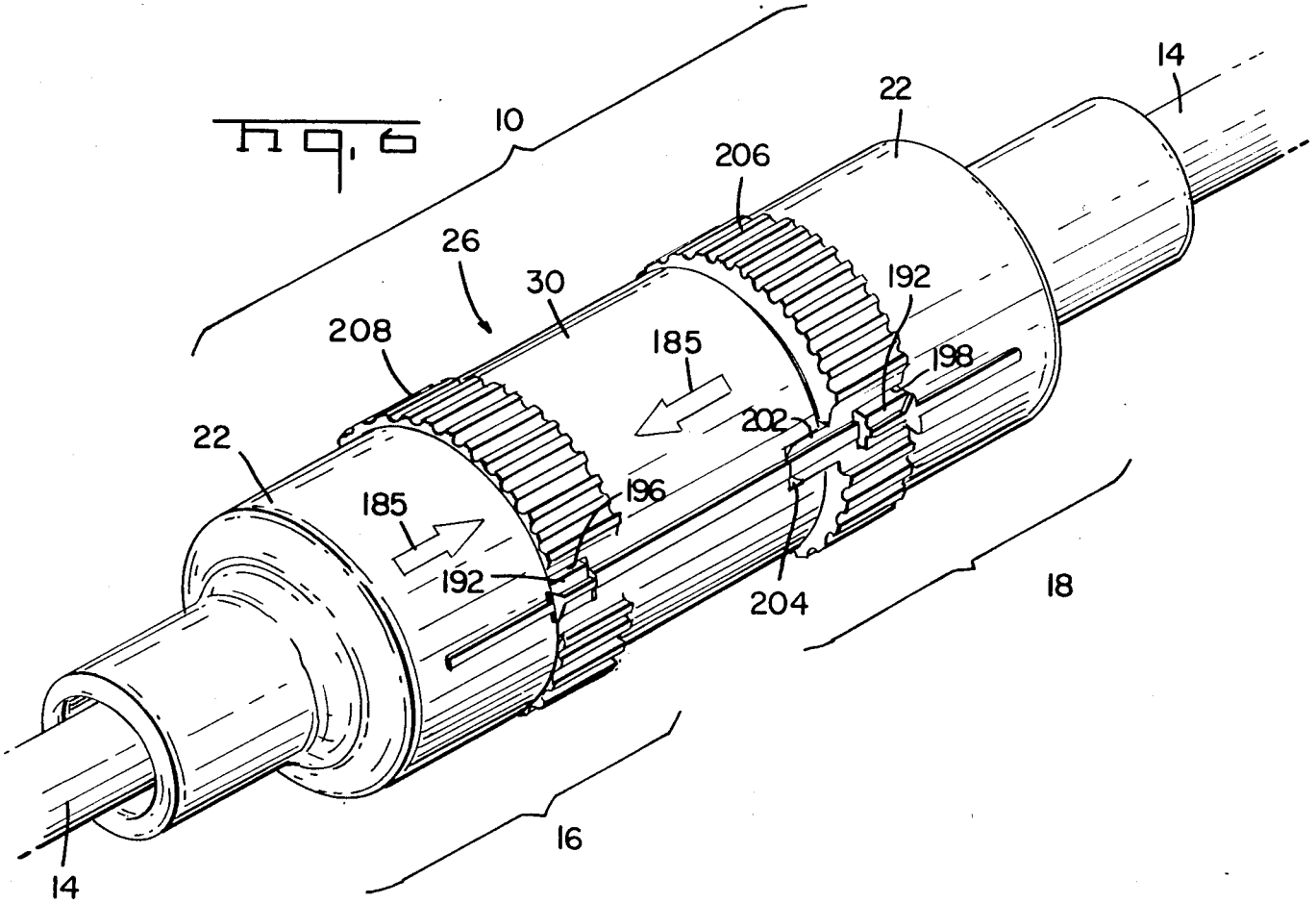
FIG. 6 is a perspective view of the inventive assembly fully coupled for operation and use.
Figure 7:
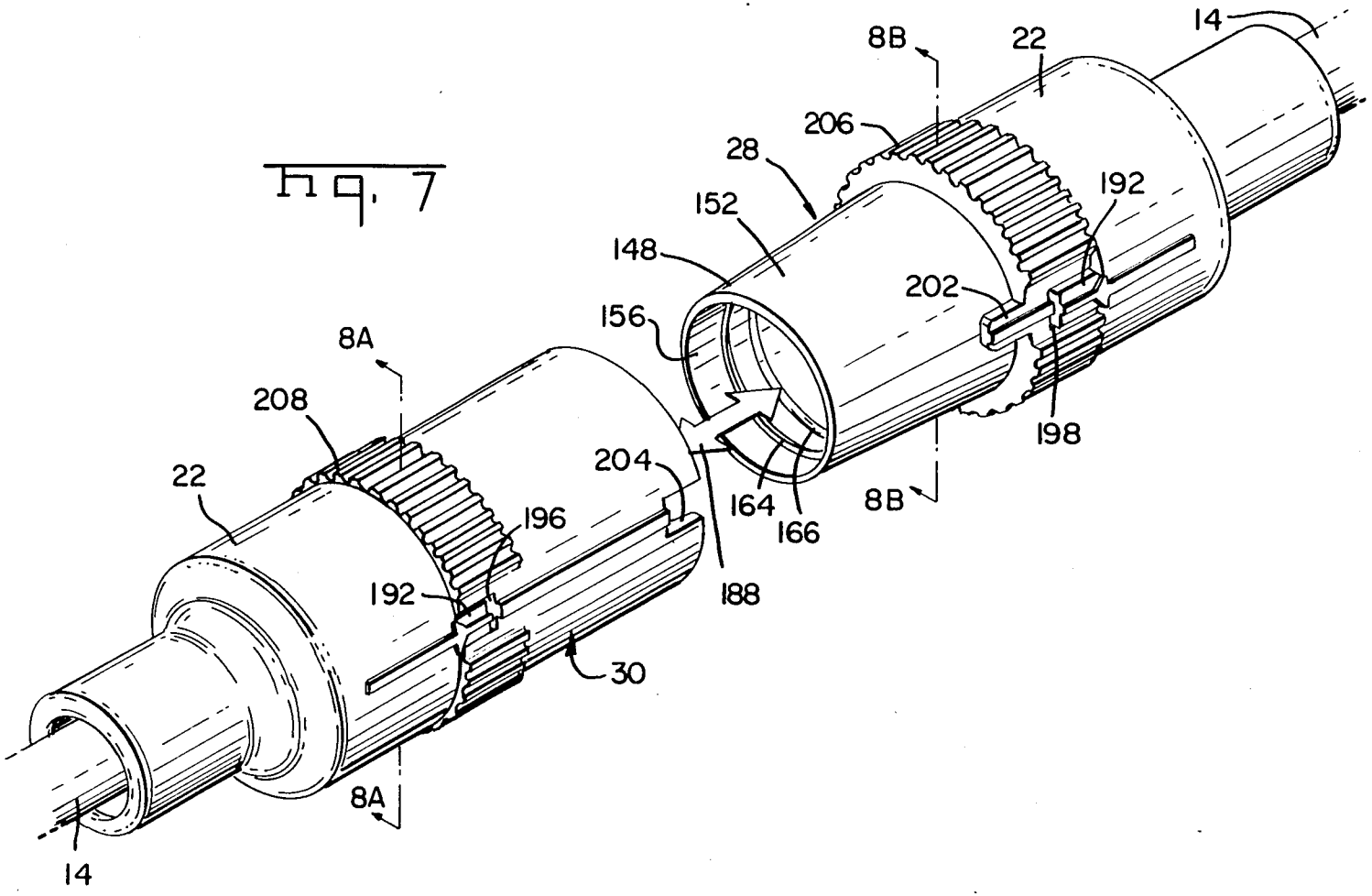

In assembling the various components as described above, each cable is first stripped at its front end to expose a bundle of electrically conductive strands or wires which are to be mechanically and electrically coupled, one to another. The stripping must be of a length so that the stripped extent will extend fully through the bores of the stator and rotor and allow the cable insulation to be within the compliant lips, preferably in abutment with the back face of the rotor. The housings are then slid onto the cables. The stripped bundles are then inserted into the bores of the elements of the cable terminals while they are oriented as shown in FIG. 2. The rotors are then rotated 180 degrees, preferably with the aid of a conventional gripping tool or tools, as illustrated by the directional arrow 178 of FIG. 3 until the abutment surfaces 56, 58 of the stators and rotors make contact to preclude further rotation. During this operation, the bores 42, 44 become offset and the electrical termination and mechanical connection between the terminals and cables is achieved. The cables and terminals are then moved inwardly into the outer housing. Note arrow 182 of FIG. 3. A visual marking 180 may be provided adjacent the front edge of the housing aligned with the slot 132 to assist an operator in correctly aligning the abutment projections 60, 62 with the slot 132 within the aperture of the housing. The male and female portions 28, 30 of the sleeve are then axially positioned onto their respective outer housings. In the alternative, the separate sleeves may be coupled to the separate housing and then the two halves coupled. The directional arrows 182, 184, 186, 188 of FIGS. 4 through 7 illustrate these movements.

A projection surface 192 on each outer housing mates with a receptive indentation 196, 198 on its associated separate sleeve portion to insure the proper rotational positioned of one element with respect to the other. Additionally, a similar axial projection 202 on the male sleeve portion mates with an associated axial slot 204 on the front end of the female sleeve portion, insure the proper alignment of the two sleeve portions and thus complete the alignment process. Each half of the assembly is then axially slid, one into the other, so that the projection and recess on each bayonet will be mated to preclude their axial separation. An audible mechanical snap can be heard by the operator to verify that the terminals have been latched and proper connection of the assembly has been made. This axial movement also fixedly engages the portions of the sleeve, one to another.

The electrical connector assembly is thus joined for operation and use with a secure mechanical connection and complete electrical coupling. Separation of the halves is precluded unless provided with a small axial rotation as by grasping the sleeve portions at their knurled exterior circumferential surfaces 206, 208 to disengage the recesses and projections of the bayonets whereupon an axial force can effect the separation of the halves of the assembly when intended by an operator. The knurls are located on the sleeve portions to constitute a gripping surface for counter-rotation of the assembly halves and the terminals.

The present disclosure includes that information contained in the appended claims as well as that in the foregoing description. Although the invention has been described in its preferred form or embodiment with a certain degree of particularity, it is understood that the present disclosure of the preferred forms has been made herein only by way of example and that numerous changes in the details of construction, fabrication, and use, including the combination and arrangements of parts, may be restored to without departing from the spirit and scope of the invention.

What is claimed is:

1. For use in an electrical connector assembly, an electrically conductive terminal for attachment to an end of a length of cable comprising:

a stator member and a rotor member rotatable with respect to each other about an axis of rotation, said stator member and said rotor member each having a bore offset from the axis of rotation for receiving a cable end when said bores are in alignment along a common axis and for terminating the received cable end when said bores are out of axial alignment as a result of relative rotation between said stator member and said rotor member.

a bayonet formed on the front end of one of said members and adapted to be positioned in contact with an associated electrial element; and resilient means attached to said bayonet for releasably latching said bayonet in contact with the associated electrical element.

2. The terminal as set forth in claim 1 and further including cylindrical means extending frontwardly of said bayonet to shroud said bayonet.

3. The terminal as set forth in claim 1 wherein one face of said bayonet lies adjacent said axis of rotation and further including attachment means on said one face and located to one side only of said axis of rotation.

4. The terminal as set forth in claim 3 wherein said attachment means includes a male projection and female recess axially aligned on said one face.

5. The terminal as set forth in claim 3 wherein said resilient means includes a leaf spring facing said one face.

6. The terminal as set forth in claim 5 wherein said resilient means further includes side supports coupled at their radially interior ends to said bayonet and at their radially exterior ends to said leaf spring.

7. An electrical connector assembly for mechanically and electrically coupling lengths of cables, said assembly including two halves, each half comprising:

an electrically conductive terminal for receiving and terminating the ends of a cable, each said terminal being hermaphroditic with male and female connecting parts arranged so that any terminal may latch with any other like terminal; and an electrically insulating housing having a central aperture adapted, at its back end, to receive the cable adjacent its end, said aperture adapted, at its front end, to receive its associated terminal, said housing also having, adjacent its front end, a circumferentially located attachment means on its raidally exterior surface, each said housing being of an identical construction so that any housing may couple with any other like housing; and said assembly also including an electrically insulating separable sleeve having sleeve portions, each said sleeve portion having, at its back end, on its radially interior surface, a circumferentially located attachment means for releasably coupling with said attachment means on said housing, at least one of said sleeve portions also having additional attachment means, at its front end, for being releasably coupled with its associated half, said sleeve portions for each assembly being male and female for being mutually coupled adjacent their front ends and for being coupled adjacent their back portions to their associated housings.

8. The assembly as set forth in claim 7 wherein the front part of one of said sleeve portions is cylindrical with its exterior surface at a fixed distance from said axis of rotation and with its interior surface tapering radialy exteriorly away from said housing.

9. The assembly as set forth in claim 7 wherein the front part of one of said sleeve portions is cylindrical with its interior surface at a fixed distance from said axis of rotation and with its exterior surface tapering radially interiorly away from said housing.

10. The assembly as set forth in claim 7 wherein the front part of each of said sleeve portions is cylindrical with an interior surface and an exterior surface and wherein each said front part includes attachment means on its interior surface.

11. The assembly as a set forth in claim 7 wherein each said bayonet has an essentially flat face containing said connecting parts and located adjacent the axis of rotation whereby said flat face may be positioned in contact with the flat face of an associated bayonet to which it is to be connected with their connecting parts in mating relationship.

12. The assembly as set forth in cliam 11 wherein said connecting parts are rotatably disengageable so that rotation between connected bayonets will separate their flat surfaces and disengage their connecting parts and thus allow an axial movement therebetween to separate the previously connected bayonets and terminals.

13. An electrical connector assembly for mechanically and electrically coupling lengths of cables, said assembly comprising:

two identically constructed, electrically conductive terminals, each for receiving and terminating a cable end to be coupled, each said terminal comprising a stator and a rotor rotatable with respect to each other about an axis of rotation, said stator and said rotor each having a bore offset from the axis of rotation of receiving a cable end when said bores are in alignment along a common axis and for holding the received cable end when said bores are out of axial alignment as a result of relative rotation between said stator and said rotor, a bayonet formed on the front end of said terminal, said bayonets being adapted to be positioned in electrical contact with each other, and further including resilient means on each said terminal to releasably secure said bayonets together;

two identically constructed, electrically insulating housings, one for each said terminal, each said housing having a central aperture adapted, at its back end, to receive a cable adjacent its end, each said housing adapted, at its front end, to receive its associated terminal, each said housing also having a circumferentially located attachment means on its radially exterior surface adjacent its front end; and a separable sleeve formed of mating sleeve portions, each said sleeve portion having, at its back end, on its radially interior surface, a circumferentially located attachment means for releasably coupling with said attachment means on said housing, at least one of said sleeve portions also having, at its front end, additional means to releasably couple said sleeve portions to each other.

14. The assembly as set forth in claim 13 wherein each terminal extends frontwardly of its associated housing and each sleeve portion extends frontwardly of its associated terminal to shield such terminal prior to the coupling of the assembly halves.

15. The assembly as set forth in claim 13 wherein the front parts of both of said sleeve portions are cylindrical with the interior surface of one of said parts at a fixed distance from said axis of rotation and with its exterior surface tapering radially interiorly away from its associated housing and with the exterior surface of the other of said parts at a fixed distance from said axis of rotation and with its interior surface tapering radially exteriorly away from its associated housing and further including attachment means on both of said radially interior surfaces.

16. The assembly as set forth in claim 15 and further including radially exteriorly projecting abutment means on each said stator and rotor to limit the rotational movement therebetween the further including an axial recess within said central aperture adjacent the front end of each said housing for receiving said abutment means to effect the proper rotational positioning between each said housing and its associated terminal.

17. The assembly as set forth in claim 16 and further including a projection extending axially frontwardly from the front ends of each said housing and recess extending axially frontwardly adjacent the back end of each said sleeve portion for receiving said projections to effect the proper rotational positioning between said sleeve portions and said housings.

18. The assembly as set forth in claim 17 and further including additional projection means and recess means on said sleeves to effect the proper rotational positioning between said sleeves.

19. The assembly as set forth in claim 15 wherein the back end of each said housing includes, on its interior surface, a circumferential compliant lip projecting radially interiorly to contact the cable adjacent its stripped end and to preclude the passage of water between said lip and the cable and wherein each said attachment means is watertight to thereby constitute a watertight seal for said terminals.

20. The assembly as set forth in claim 19 wherein said sleeve portions and said housings are fabricated of an elastomeric material with the back end of each said housing being of a durometer hardness less than its front end.

21. The assembly as set forth in claim 13 wherein each said bayonet has an essentially planar surface in mutual facing relationship and located adjacent said axis of rotation and further including bayonet attachment means on each said essentially planar surface.

22. The assembly as set forth in claim 21 wherein each said bayonet attachment means includes a recess and a projection positioned whereby said resilient means will resiliently bias said bayonets together with said recesses and projections in mating engagement so as to preclude the axial movement of said bayonets with respect to each other.

23. The assembly as set forth in claim 22 wherein said bayonet attachment means are located on one side only of said axis of rotation so that a slight counter-rotation of said terminals and said bayonets about said axis of rotation will separate said bayonet attachment means of one said bayonet from said bayonet attachment means of the other said bayonet against the bias of said resilient means to allow the axial movement and separation of said bayonets and said terminals.

24. The assembly as set forth in claim 23 wherein said projections and said recesses are axially spaced and located at identical positions on each said bayonet, so that when said bayonets are in facing, operational contact, said projections and said recesses are in mating engagement and said bayonets thus form a hermaphroditic coupling.

* * * * *